US010104908B2

(12) United States Patent
Balder et al.

(10) Patent No.: US 10,104,908 B2
(45) Date of Patent: Oct. 23, 2018

(54) ELECTRONIC VAPING MATERIAL CONTAINER

(71) Applicant: Healthier Choices Management Corp, Hollywood, FL (US)

(72) Inventors: Edwin Balder, Mesa, AZ (US); Gilbert Cyphert, Phoenix, AZ (US); Daniel Julia, Phoenix, AZ (US)

(73) Assignee: HEALTHIER CHOICES MANAGEMENT CORP, Hollywood, FL (US)

( * ) Notice: Subject to any disclaimer, the term of this patent is extended or adjusted under 35 U.S.C. 154(b) by 0 days.

(21) Appl. No.: 15/908,304

(22) Filed: Feb. 28, 2018

(65) Prior Publication Data

US 2018/0184706 A1 Jul. 5, 2018

Related U.S. Application Data

(60) Continuation of application No. 15/832,582, filed on Dec. 5, 2017, which is a continuation-in-part of application No. 15/603,263, filed on May 23, 2017, now Pat. No. 9,949,506, which is a division of application No. 13/987,851, filed on Sep. 9, 2013, now Pat. No. 9,687,025.

(60) Provisional application No. 61/743,720, filed on Sep. 10, 2012.

(51) Int. Cl.

| | |
|---|---|
| ***A24F 47/00*** | (2006.01) |
| ***A61M 15/06*** | (2006.01) |
| ***A24F 1/00*** | (2006.01) |

(52) U.S. Cl.
CPC ..... *A24F 1/00* (2013.01); *A24F 47/008* (2013.01)

(58) Field of Classification Search
CPC ..... A24F 47/00; A61M 15/06
See application file for complete search history.

(56) References Cited

U.S. PATENT DOCUMENTS

| | | | | |
|---|---|---|---|---|
| 1,372,124 | A * | 3/1921 | Downey | A24F 19/14 131/235.1 |
| 2,542,612 | A * | 2/1951 | Arneson | A24D 1/04 131/187 |
| 3,422,821 | A * | 1/1969 | Calkins | A24F 1/22 131/195 |
| 2006/0130857 | A1 * | 6/2006 | Roth | A24F 47/002 131/273 |

(Continued)

*Primary Examiner* — Cynthia Szewczyk
(74) *Attorney, Agent, or Firm* — Lewis Brisbois Bisgaard & Smith LLP; Geoffrey Lottenberg

(57) ABSTRACT

An inhalant material container for electronic smoking device is a cup-like storage container with an open top and a closed bottom. The container is made of quartz, glass, or other like materials. The container has a frangible seal covering the open top and an aperture to promote air flow through the container. The container is removably inserted into the heating chamber of an electronic smoking device. The container allows for heating of the inhalant material with the material coming in direct contact with the heating element in the heating chamber. The container is easily removed and replaced for on demand use. The container can be used in conjunction with a threaded connector and a two-piece heating chamber. The two-piece heating chamber has an internal punch to automatically puncture the seal of the container prior to use.

7 Claims, 9 Drawing Sheets

(56) References Cited

U.S. PATENT DOCUMENTS

| | | | | |
|---|---|---|---|---|
| 2010/0024834 | A1* | 2/2010 | Oglesby | A24F 47/006 131/194 |
| 2011/0068026 | A1* | 3/2011 | Fakhouri | A24F 9/04 206/244 |
| 2012/0255567 | A1* | 10/2012 | Rose | A61K 9/12 131/273 |
| 2013/0152922 | A1* | 6/2013 | Benassayag | A61M 15/06 128/202.21 |
| 2015/0374032 | A1* | 12/2015 | De Gaglia | A24F 1/30 131/225 |
| 2016/0165956 | A1* | 6/2016 | Tucker | H01C 17/00 131/329 |
| 2016/0309785 | A1* | 10/2016 | Holtz | A24F 47/008 |

* cited by examiner

ELECTRONIC VAPING MATERIAL CONTAINER

This application is a continuation of U.S. patent application Ser. No. 15/832,582 filed Dec. 5, 2017, which is continuation-in-part of U.S. patent application Ser. No. 15/603,263, filed May 23, 2017, which is a divisional of U.S. patent application Ser. No. 13/987,851 filed Sep. 9, 2013, now U.S. Pat. No. 9,687,025, which claims the benefit of U.S. Provisional Application 61/743,720 filed on Sep. 10, 2012.

FIELD OF THE INVENTION

The present invention relates to electronic cigarettes and vaporizers.

BACKGROUND OF THE INVENTION

In an attempt to solve the problems of traditional smoking, electronic cigarettes and vaporizers have come to the forefront. These devices employ the use of a liquid, concentrate, or dry material inhalants that often comprise glycol ad-mixtures, wax-like substances, herbs, flowers, and other medicinal substances. In the conventional art, the inhalant is placed on or otherwise drawn to and over a metal heating element, such as a metal coil, which coil receives electrical energy from an on-board battery. The electrical energy is converted to heat, thereby heating and vaporizing the inhalant material brought in contact with the heating element. The resultant vapor, smoke, or other aerosol is then inhaled by way of a mouthpiece in fluid communication with an air channel disposed through the device.

The downside of traditional electronic cigarettes and vaporizer systems is that repeated heating and cooling of the metal heating element will cause transfer of heavy metals into the resultant vapor or smoke, resulting in inhalation of harmful and unwanted heavy metal material. Recent studies have in fact shown that heavy metal exposure caused by traditional electronic cigarettes and vaporizers is as harmful as or possibly more harmful than exposure to the carcinogens found in traditional cigarettes.

In addition to the toxicity issues associated with direct contain between the target inhalant material and the metal heating coil, traditional electronic cigarette and vaporizer systems suffer from degradation of and eventual loss of performance due to waste buildup on the metal coil and the surrounding area. As the buildup continues to develop, the device tends to generate less available smoke or vapor and the flavor and "hit" consistency will be impacted. Sooner than later the metal coil will need to be cleaned using toxic chemicals or, in most cases, will need to be replaced regularly. Moreover, it is often difficult or simply inconvenient to load a heating chamber of an electronic smoking device with the inhalant material. For example, in some known concentrate and/or dry material heating chambers, the inhalant material has to be manually inserted and/or manually placed onto the heating coils inside the chamber. These chambers are small and present tight quarters that are difficult or impossible to access for cleaning and can gum up to ill effect.

The nature of heating any material to the point of vaporization or combustion in a nontoxic manner where the element or compound phase transition from the liquid phase to vapor occurs in an inhalation device demands that safety protocols are generously incorporated. Additionally, the performance degradation and convenience issues need to be addressed in order to provide a reliable more user-friendly system. The present invention employs inhalant material container and related system that is a radical departure from the common electronic cigarette, smoking, and vaporization systems known in the art. The present invention demonstrates a key advantage in reduction of trace harmful elements such as heavy metals that have been shown to be delivered to the user due to direct contact of the inhalant material to the traditional metal heat source.

Accordingly, the present invention is directed at reducing and/or eliminating heavy metal contamination found in traditional vaporizer systems while also enhancing the durability and performance of vaporizer system components.

Figure 1A:
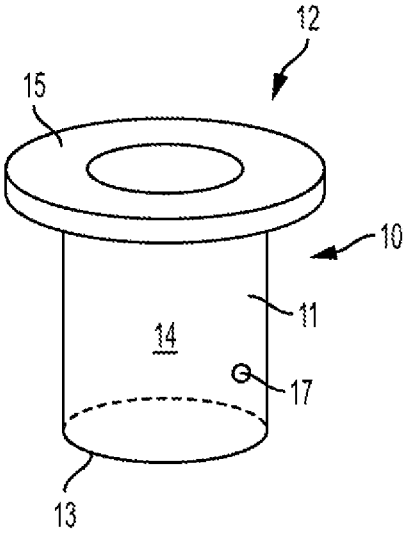
FIG. 1A is a perspective view of the material container.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. Throughout this description, the embodiments and examples shown should be considered as exemplars, rather than as limitations. That is, the following description provides examples, and the accompanying drawings show various examples for the purposes of illustration. However, these examples should not be construed in a limiting sense as they are merely intended to provide examples of the present invention rather than to provide an exhaustive list of all possible implementations.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "some embodiments" or "one embodiment" or "an embodiment" means that a particular feature, structure or characteristic described in connection with the embodiment is included in at least one embodiment of the present invention. Thus, appearances of the phrases "in some embodiments" or "in an embodiment" in various places throughout this specification are not necessarily all referring to the same embodiment. Furthermore, the particular features, structures or characteristics may be combined in any suitable manner in one or more embodiments.

For purposes of this disclosure, the terms "electronic cigarette" and "vaporizer" are interchangeable and generally refer to an electronic device configured to heat a target inhalant material to be inhaled by the user by mouth. "Inhalant material" for purposes of this disclosure refers to any desired material to be heated and inhaled by way of the electronic cigarette or vaporizer. Such materials include, without limitation, liquids such as glycol-based solutions, semi-solid or solid concentrates such as oils and waxes, and dry material such as tobacco, herbs, flowers, and aromatics. The term "vaping" refers generally to the act of using electronic cigarettes and vaporizers for the purposes of generating vapor, smoke, aerosol or other material to be inhaled for pleasure or for the delivery of medicaments or substances to the body; notably, the term is not limited to the act of generating or inhaling only vapor—it refers more broadly to the act of inhaling material by way of electronic devices, as opposed to traditional smoking implements such as cigarettes, pipes, cigars, and the like.

Figure 1B:
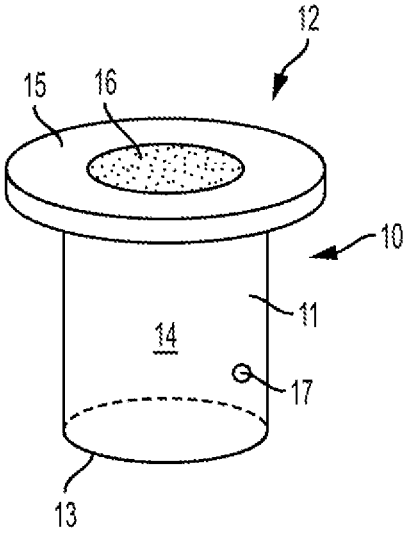
FIG. 1B is a perspective view of the material container with a seal disposed thereon.

With reference to FIG. 1A shown is an embodiment of an electronic vaping material container 10. In some embodiments, the container 10 comprises a cup-shaped housing 11 having open top 12 and closed bottom 13. The container 10 delimits an internal storage area 14 wherein inhalant material may be placed. In some embodiments, the upper perimeter edge of the housing 11 comprises a lip 15. As further described, the lip 15 is configured to engage the top of the heating chamber of a target electronic smoking device and/or a connector as further described herein. In some embodiments, as shown in FIG. 1B removable or frangible seal 16 covers and seals the otherwise open top of the container 10. The seal 16 may comprise a variety of materials such as paper, parchment, foil, or plastic and may be sealed to the container by heat-sealing methods or by an adhesive. In some embodiments, the container 10 includes an aperture 17 disposed through the housing 11 or the bottom 13 or other appropriate and desired location on the container 10. The aperture 17 introduces airflow through the container 10. In some embodiments the internal storage area 14 is pre-filled with inhalant material and then the seal 16 is applied so that the pre-filled container 10 can be handled and have a shelf life. In other embodiments, the container 10 is provided empty for the user to fill manually as desired.

The container 10 is configured in various shapes and sizes to accommodate the geometry of the heating chamber of a target electronic smoking device. Accordingly, in some embodiments, the bottom 13 of the container 10 may be flat, concave, convex, rippled, or textured. Similarly, the housing 11 may vary in shape, size, and configuration and may be cylindrical, conical, square-shaped, and the like. The container 10 comprises a heat-conductive but resilient material such as quartz, glass, silica-containing compositions, or any like-performing composition. The container 10 is designed to be an insertable and removable inhalant material container to be used with a variety of electronic smoking devices.

Figure 2A:
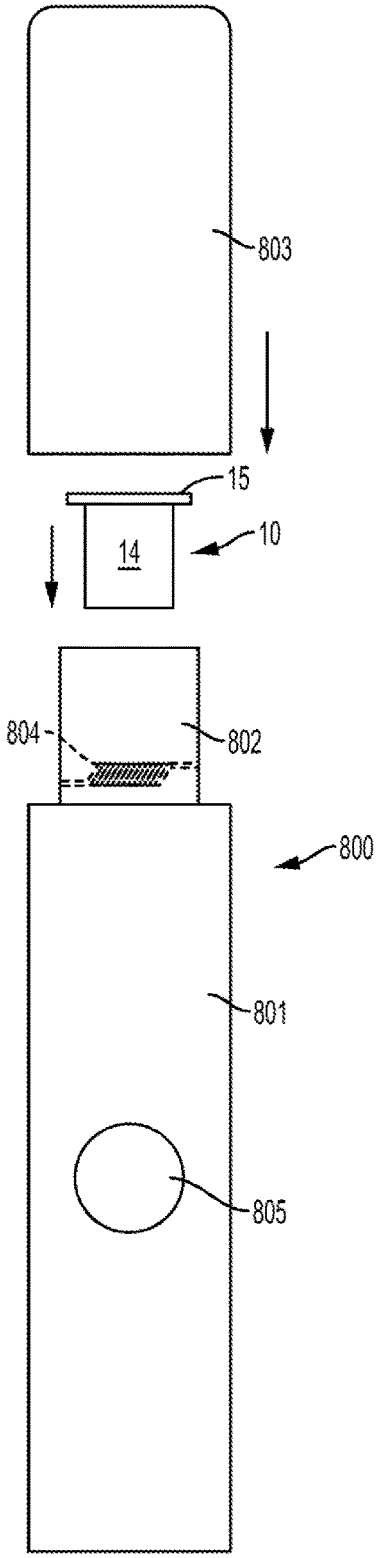
FIG. 2A is an exploded view showing the material container in use with an electronic smoking device.
Figure 2B:
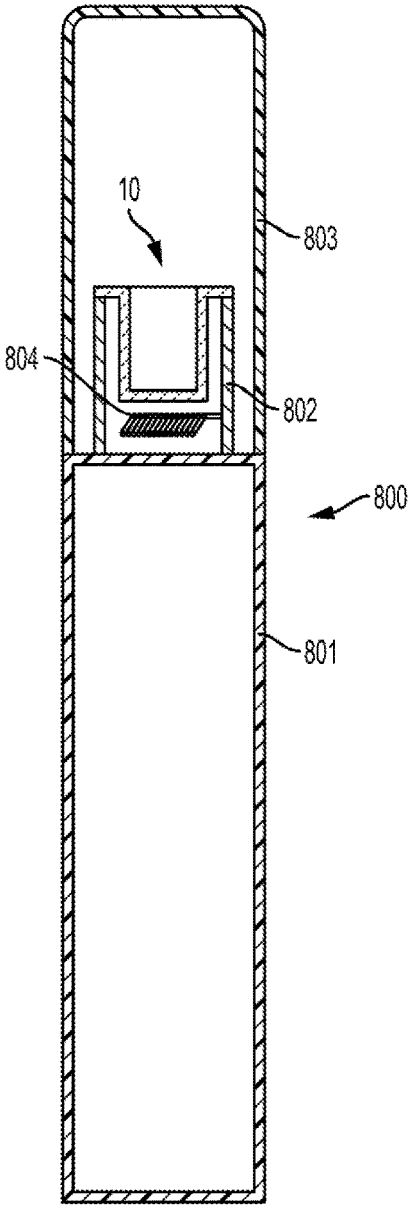
FIG. 2B is a cutaway assembled view showing the material container in use with an electronic smoking device.

With reference to FIGS. 2A and 2B, shown is the container 10 in use with an exemplary electronic smoking device 800. The configuration of smoking device 800 is for exemplary purposes only, but in this case comprises a "mini-type" vaporizer that includes a control section 801, a heating chamber 802, and a removable mouthpiece 803. The control section 801 comprises a battery and chipset to control the device 800. The heating chamber 802 is open topped cup-like device and includes a heating element 804, such as a coil or wire, disposed therein. In some embodiments, the heating chamber 802 is removably and threadingly engaged with the control section 801 to provide a physical and electrical connection. In some embodiments, the mouthpiece 803, heating chamber 802 and/or the control section 801 include external apertures and air passages to allow for the passage of air through the system in order to draw vapor, smoke, or aerosol there-through.

Traditionally, in these types of units, the inhalant material is to be manually inserted into the heating chamber 802 such that it comes in direct contact with the heating element 804 and the inside of the heating chamber 802. This direct contact, which causes a toxic reaction and build-up inside the heating chamber 802, is obviated by the container 10. Accordingly, the container 10 is configured and dimensioned to be inserted into and removably retained by the heating chamber 802. In some embodiments, the container 10 fits security inside the heating chamber 802 by way of an interference fit. In some embodiments, the container 10 is inserted deep enough into the heating chamber 802 such that the lip 15 of the container rests on and stops at the top edge of the heating chamber 802. This puts the bottom 13 of the container 10 on or adjacent to the heating element 804. Accordingly, the lip 15 provides an enhanced, secure fitment structure for the container 10 and also provides a grasping point for the insertion and removal of the container 10 as desired. In some embodiments, after the container 10 is loaded into the heating chamber 802, the mouthpiece 803 is disposed over the area surrounding the heating chamber 802 and container 10 and snaps onto or is otherwise secured to the control section 801. The seal 16, if provided, is removed from the container 10 or punctured or broken prior to closing the device.

In use, the user activates the device 800, typically by a control button 805, which applies electrical current to the heating element 804, which generates heat. Heat generated by the heating element 804 passes through the container 10 and thereby heats the inhalant material held in the internal storage area 14. The inhalant material then turns into a vapor, smoke, or aerosol to be inhaled by the user through air passages within the device and out of the mouthpiece 803. Notably, air passes through the device 800 components and through the aperture 17 of the container 10 such that the vapor, smoke, or aerosol is released and pulled out of the open top 12 of the container 10 and through and out of the mouthpiece 803. Once the inhalant material has been exhausted from the container 10, the container 10 can be removed and replaced for the next session. Notably, the use of the container 10 avoids any direct contact between the inhalant material and the heating element 804 thereby preventing a toxic reaction and preventing residue from building up on the heating element 804 and within the heating chamber 802. The container 10 is easily replaced for the next use, while the heating element remains clean and unobstructed.

In some embodiments, the container 10 is configured to be universally adaptable to a wide variety of electronic smoking devices and the varied shape and configured heating chambers that such devices implement. Accordingly, the present invention contemplates several embodiments of connectors that can be attached to the container 10 to permit the container 10 to be inserted and retained by a variety of heating chambers and electronic smoking device components.

With reference to FIGS. 3A-3D, shown is a male-to-male threaded connector 300 that is configured to attach to the container 10 so that the container 10 can be connected to other threaded components of an electronic smoking device. Connector 300 comprises a generally annular member having a first externally threaded end 301 and a second, opposing externally threaded end 302. Disposed between the two threaded ends 301 and 302 is a center section 303 that spaces-apart the two ends 301 and 302 from one another. In some embodiments, the diameter of the center section 303 is wider than that of the ends 301 and 302. Further still, in some embodiments, the diameter of the threaded end sections 301 and 302 are different; for example, threaded end 301 has a larger diameter than threaded end 302 to accommodate varied sized components and accessories of an electronic smoking device.

Figure 3A:
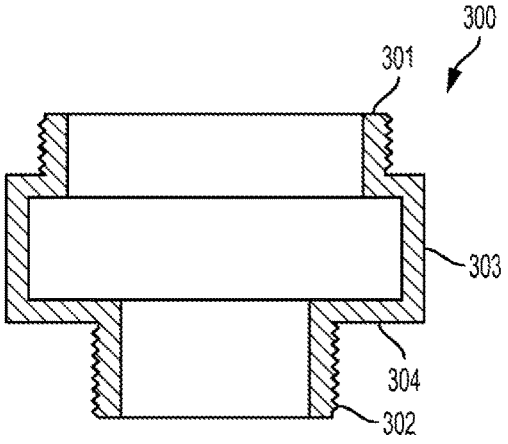
FIG. 3A is a cutaway view of a male-to-male threaded connector to be used in conjunction with the container.
Figure 3B:
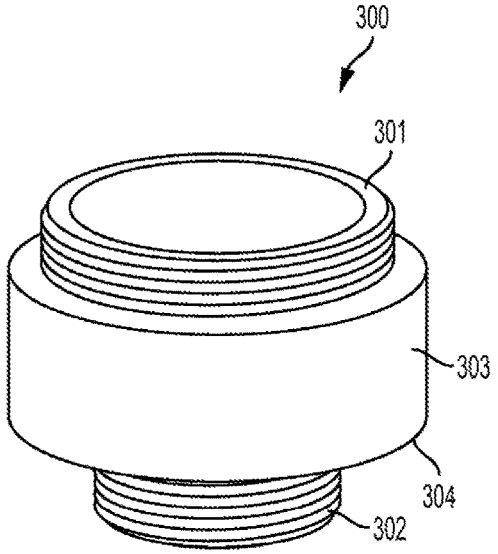
FIG. 3B is a perspective view of the threaded connector shown in FIG. 3A.
Figure 3C:
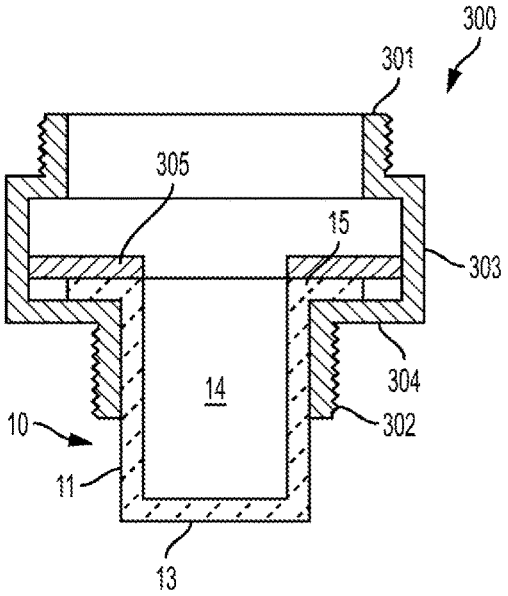
FIG. 3C is a cutaway view of the threaded connector shown in FIG. 3A with the container inserted therein.
Figure 3D:
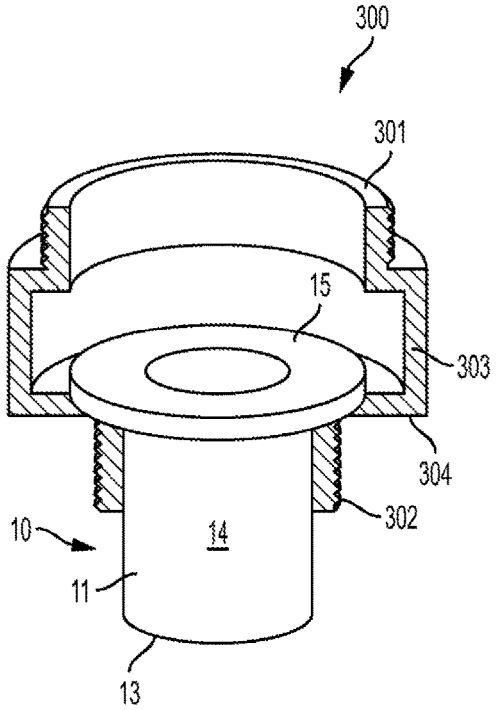
FIG. 3D is a cutaway perspective view of the threaded connector shown in FIG. 3A with the container inserted therein.

As shown in FIG. 3C, the connector 300 is at least partially bored out or hollow to accommodate the container 10 to provide way to connect the container 10 to various components of an electronic smoking device. In some embodiments, the container 10 is inserted through the first end 301 of the connector 300 and then is translated downward such that the lip 15 thereof is seated against the shelf 304 at the transition between the center section 303 and the second end 302. In some embodiments, the lower portion of the container 10 extends away from the second end 302 such that it is exposed from the connector 300. This permits the container 10 to receive direct heat from a heating chamber of an electronic smoking device. In some embodiments, an optional washer 305 is inserted above and/or below the lip 15 of the container 10 to further secure the container 10 and reinforce the threaded connections made with the connector 300. With the container 10 seated in the connector 300, the externally threaded second end 302 is now surrounding at least a portion of the container 10 in order to provide a means to connect the container 10 to other compatible components of an electronic smoking device, such as female threaded components. The first end 301 can be provisioned to connect to other components as well, with the connector 300 functioning as a coupler between components while also securing the container 10 in or to the electronic smoking device. Note also that the connector 300 is bi-directional in that the container 10 can be inserted in the opposite way to that shown, with the first end 301 being the end disposed around the container 10 and the second end 302 available to connect to other components. Additional washers 305 may be employed to improve the fit of the container 10 within the connector 300, regardless of which installation direction is used.

Figure 4A:
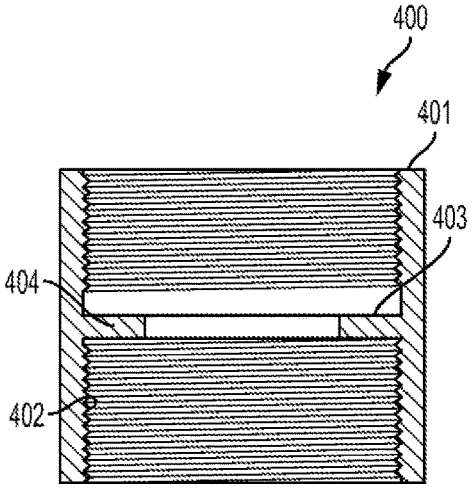
FIG. 4A is a cutaway view of a female-to-female threaded connector to be used in conjunction with the container.
Figure 4B:
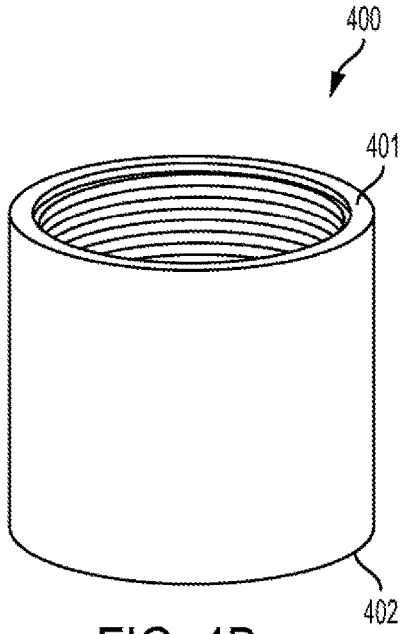
FIG. 4B is a perspective view of the threaded connector shown in FIG. 4A.
Figure 4C:
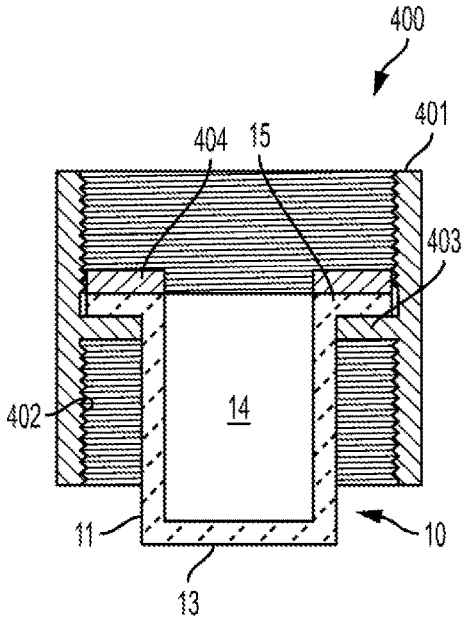
FIG. 4C is a cutaway view of the threaded connector shown in FIG. 4A with the container inserted therein.
Figure 4D:
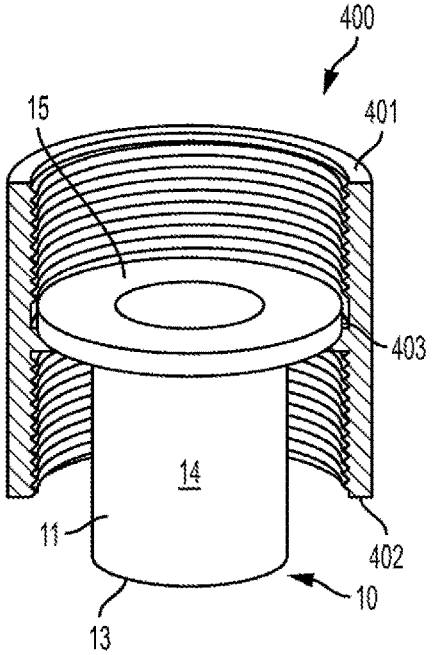
FIG. 4D is a cutaway perspective view of the threaded connector shown in FIG. 4A with the container inserted therein.

With reference to FIGS. 4A-4D, shown is a female-to-female threaded connector 400 that is configured to attach to the container 10 so that the container 10 can be connected to other threaded components of an electronic smoking device. Connector 400 comprises a generally annular member having a first internally threaded end 401 and a second, opposing internally threaded end 402. Disposed between the two threaded ends 401 and 402 is an internal rim 403 that offsets that two ends 401 and 402 from one another. As shown in FIG. 4C, the connector 400 is at least partially bored out or hollow to accommodate the container 10 to provide way to connect the container 10 to various components of an electronic smoking device. In some embodiments, the container 10 is inserted through the first end 401 of the connector 400 and then is translated downward such that the lip 15 thereof is seated against the internal rim 403. In some embodiments, the lower portion of the container 10 extends away from the second end 402 such that it is exposed from the connector 400. This permits the container 10 to receive direct heat from a heating chamber of an electronic smoking device. In some embodiments, an optional washer 404 is inserted above and/or below the lip 15 of the container 10 to further secure the container 10 and reinforce the threaded connections made with the connector 400. With the container 10 seated in the connector 400, the internally threaded second end 402 is now surrounding at least a portion of the container 10 in order to provide a means to connect the container 10 to other compatible components of an electronic smoking device, such as male threaded components. The first end 401 can be provisioned to connect to other components as well, with the connector 400 functioning as a coupler between components while also securing the container 10 in or to the electronic smoking device. Note also that the connector 400 is bi-directional in that the container 10 can be inserted in the opposite way to that shown, with the first end 401 being the end disposed around the container 10 and the second end 402 available to connect to other components. Additional washers 405 may be employed to improve the fit of the container 10 within the connector 400, regardless of which installation direction is used.

With reference to FIGS. 5A-5D, shown is a female-to-male threaded connector 500 that is configured to attach to the container 10 so that the container 10 can be connected to other threaded components of an electronic smoking device. Connector 500 comprises a generally annular member having a first externally threaded end 501 and a second, opposing internally threaded end 502. Disposed between the two threaded ends 501 and 502 is an internal shelf 503 that transitions the two ends 501 and 502 from one another. In some embodiments, the diameter of the first end 501 is larger than that of the second end 502 to accommodate varied sized components and accessories of an electronic smoking device and to accommodate the difference in thread configuration, i.e. male vs. female.

Figure 5A:
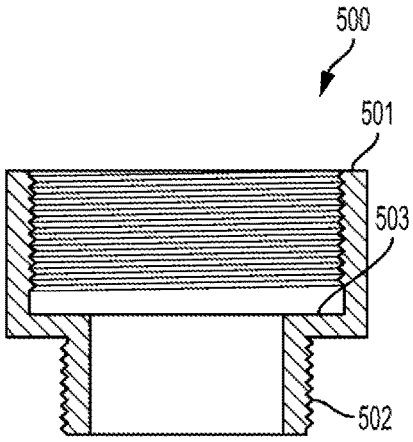
FIG. 5A is a cutaway view of a female-to-male threaded connector to be used in conjunction with the container.
Figure 5B:
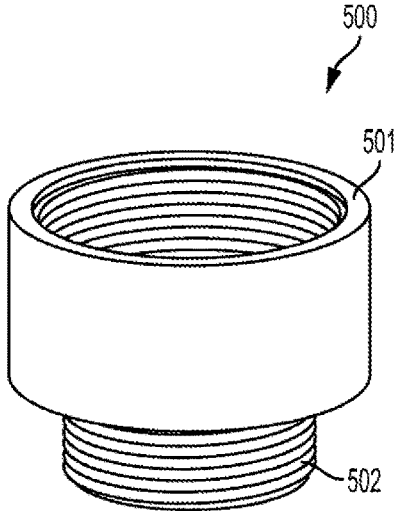
FIG. 5B is a perspective view of the threaded connector shown in FIG. 5A.
Figure 5C:
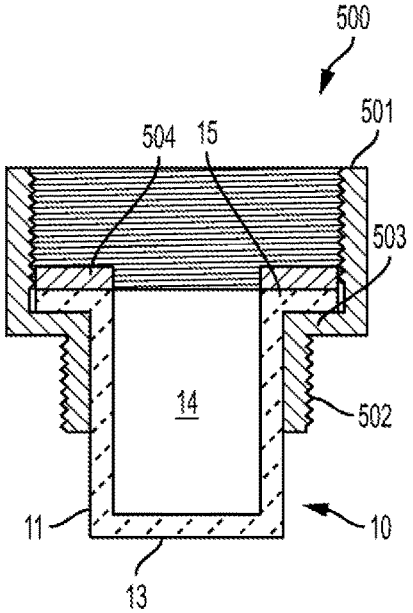
FIG. 5C is a cutaway view of the threaded connector shown in FIG. 5A with the container inserted therein.
Figure 5D:
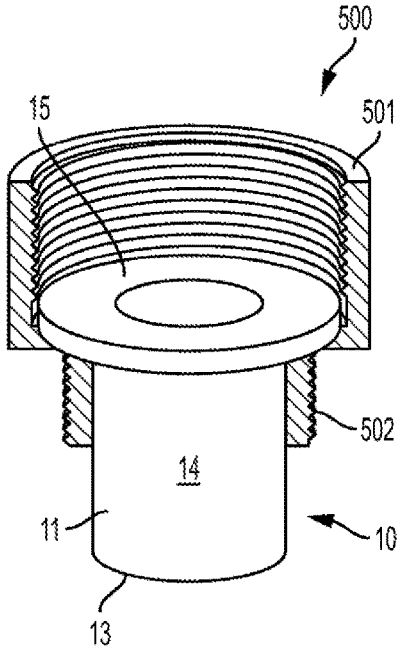
FIG. 5D is a cutaway perspective view of the threaded connector shown in FIG. 5A with the container inserted therein.

As shown in FIG. 5C, the connector 500 is at least partially bored out or hollow to accommodate the container 10 to provide way to connect the container 10 to various components of an electronic smoking device. In some embodiments, the container 10 is inserted through the first end 501 of the connector 500 and then is translated downward such that the lip 15 thereof is seated against the shelf 503 at the transition between the two ends 501 and 502. In some embodiments, the lower portion of the container 10 extends away from the second end 502 such that it is exposed from the connector 500. This permits the container 10 to receive direct heat from a heating chamber of an electronic smoking device. In some embodiments, an optional washer 504 is inserted above and/or below the lip 15 of the container 10 to further secure the container 10 and reinforce the threaded connections made with the connector 500. With the container 10 seated in the connector 500, the externally threaded second end 502 is now surrounding at least a portion of the container 10 in order to provide a means to connect the container 10 to other compatible components of an electronic smoking device, such as female threaded components. The internally threaded first end 501 can be provisioned to connect to other components as well, with the connector 500 functioning as a coupler between components while also securing the container 10 in or to the electronic smoking device. Note also that the connector 500 is bi-directional in that the container 10 can be inserted in the opposite way to that shown, with the first end 501 being the end disposed around the container 10 and the second end 502 available to connect to other components. Additional washers 504 may be employed to improve the fit of the container 10 within the connector 500, regardless of which installation direction is used.

Figure 6A:
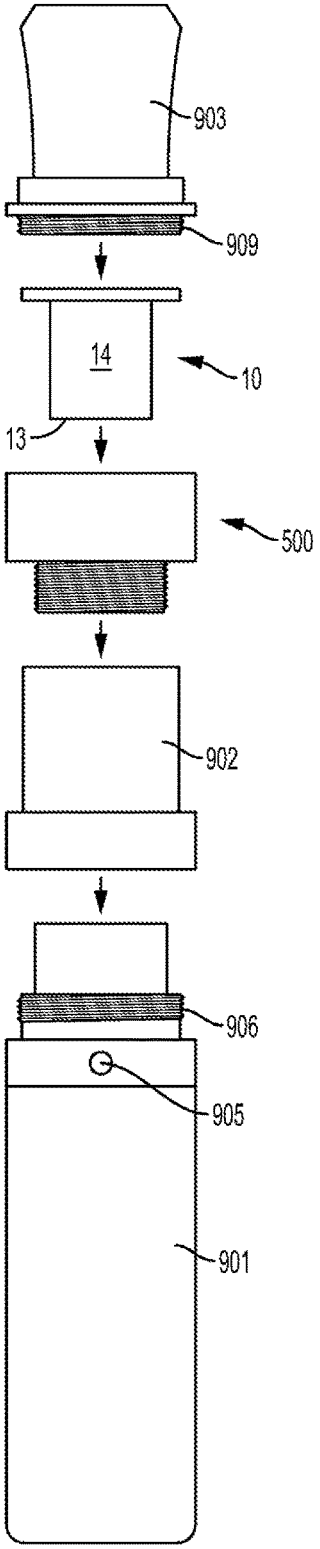
FIG. 6A is an exploded view showing the material container and connector in use with an electronic smoking device.
Figure 6B:
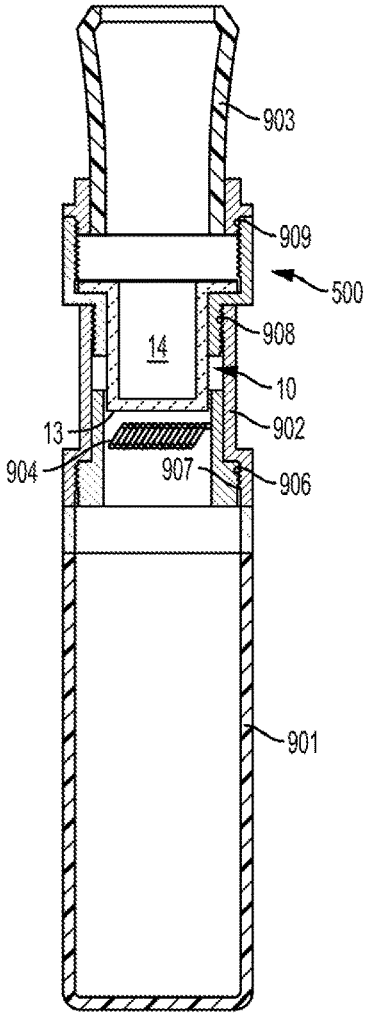
FIG. 6B is a cutaway assembled view showing the material container and connector in use with an electronic smoking device.

With reference to FIGS. 6A and 6B, shown is the container 10 in use with an exemplary electronic smoking device 900. The configuration smoking device 900 is for exemplary purposes only, but in this case comprises a modular type vaporizer that includes a control section 901, a heating chamber 902, and a mouthpiece 903. The control section 901 comprises a battery and chipset to control the device 900. The heating chamber 902 is threaded cylindrical device and includes a heating element 904, such as a coil or wire, disposed therein. In some embodiments, the heating chamber 902 is removably and threadingly engaged with the control section 901 to provide a physical and electrical connection. The control section 901 has a male threaded attachment point 906 that engages the internally or female threaded lower attachment point 907 of the chamber 902. The opposite end of the chamber 902, i.e. the upper portion, has an internally or female threaded attachment point 908. In some embodiments, the mouthpiece 903, heating chamber 902 and/or the control section 901 include external apertures and air passages to allow for the passage of air through the system in order to draw vapor, smoke, or aerosol therethrough.

Traditionally, in these types of units, the inhalant material is to be manually inserted into the heating chamber 902 such that it comes in direct contact with the heating element 904 and the inside of the heating chamber 902. This direct contact, which causes a toxic reaction and build-up inside the heating chamber 902, is obviated by the container 10. However, in comparison to the mini-type device 800 shown in FIGS. 2A and 2B, the heating chamber 902 of device 900 has a threaded attachment 908 that is traditionally arranged to threadingly receive and attach to the mouthpiece 90, whereas in the device 800 in FIG. 2A, the mouthpiece does not engage the chamber 802, it is disposed over and around it. Accordingly, in order to install the container 10 into the heating chamber 902 and to permit the other components to attach properly, a male-to-female connector 500 is employed.

The container 10 is configured and dimensioned to be inserted into the connector 500 substantially as shown in FIGS. 5A-5C. Then the container-loaded connector 500 is inserted into the heating chamber 902 and the male threaded second end 502 is threaded into the female threaded upper attachment point 908 of the chamber 902. Then the mouthpiece 903, which is shown as having male threads 909, is threaded into the female threaded first end 502 of the connector 500. This configuration properly seats the container 10 into the heating chamber 902 with the bottom 13 thereof at or adjacent to the heating coil 904. Washers 504 can be placed in desired locations adjacent to (i.e., above or below) the lip 15 of the container 10 to further secure the container 10 within the device 900. The seal 16, if provided, is removed, broken, or punctured prior to closing the device.

In use, the user activates the device 900, typically by a control button 905, which applies electrical current to the heating element 904, which generates heat. Heat generated by the heating element 904 passes through the container 10 and thereby heats the inhalant material held in the internal storage area 14. The inhalant material then turns into a vapor, smoke, or aerosol to be inhaled by the user through air passages within the device and out of the mouthpiece. Notably, air passes through the device 900 components and through the aperture 17 of the container 10 such that the vapor, smoke, or aerosol is released and pulled out of the container 10 and through and out of the mouthpiece 903. Once the inhalant material has be exhausted from the container 10, the container 10 can be unscrewed from the device 900, removed from the connector 500, and replaced for the next session. Notably, the use of the container 10 avoids any direct contact between the inhalant material and the heating element 904 thereby preventing a toxic reaction and preventing residue from building up on the heating element 904 and within the heating chamber 902. The container 10 is easily replaced for the next use, while the heating element remains clean and unobstructed.

The configuration of device 900 shown in FIGS. 6A and 6B, like the other illustrations, is exemplary. Other configurations with respect to the device components and the location and orientation of the threaded connectors can vary. Accordingly, one may select the appropriate connector 300, 400, or 500, depending on the construction and needs of the particularly electronic smoking device. For example, if the upper attachment point 908 of the heating chamber 902 were externally threaded, than the female-to-female connection 400 would be most appropriate to accommodate the heating chamber 902 below and the mouthpiece 903 above. Further still, the connectors 300, 400, and 500 can be coupled to one another in order to vary the nature of the threads, i.e. male or female, and also to function as a spacer to accommodate larger components or indeed, larger containers 10.

With reference to FIGS. 7A-7E, shown is a two-piece heating device 700 that is configured to accommodate the container 10. The chamber 700 includes a substantially hollow upper cradle 701 and a lower heating chamber 702 that are moveably and/or hingably connected. In some embodiments the cradle 701 and chamber 702 are joined by a hinge 703; however, other connections are contemplated such as a swivel mount rod so that the two pieces can swing across one another. In some embodiments, the cradle 701 and chamber 702 are generally cylindrical in shape and have matching dimensions. In some embodiments, either or both of the cradle 701 and chamber 702 include an aperture 706 to permit the passage of air therethrough. In some embodiments, the upper part of the upper cradle 701 is threaded, either internally or external, to accommodate a mouthpiece. In other cases a mouthpiece may be attached to or inserted into the upper cradle 701 by other means such as a friction or interference fit. In some embodiments, disposed inside and extending downward from the upper cradle 701 is an internal punch 709. The punch 709 as shown is a hollow conical element but other configurations are contemplated, such as a solid needles, angle cut tipped piercing members, and the like. The punch 709 is configured to automatically upon closing of the cradle 701 over the chamber 702 break or puncture the seal 16 of the container 10 prior to use. In the case that the punch 709 is hollow, it delimits an air channel airway through the heating device 700 to allow for the passage of aerosol from the container 10 through the upper cradle 701 and through and out of the mouthpiece connected thereto.

Figure 7A:
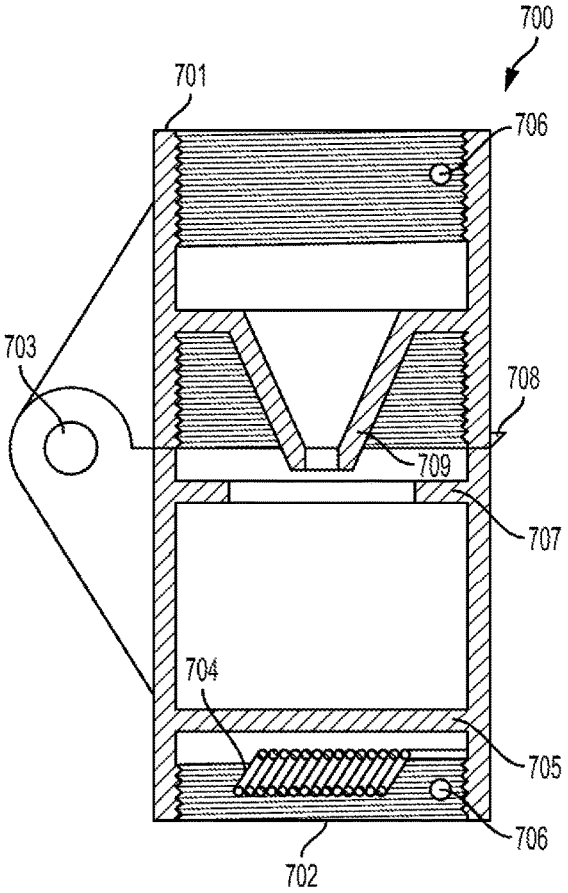
FIG. 7A is a cutaway view of a heating device to be used in conjunction with the container.
Figure 7B:
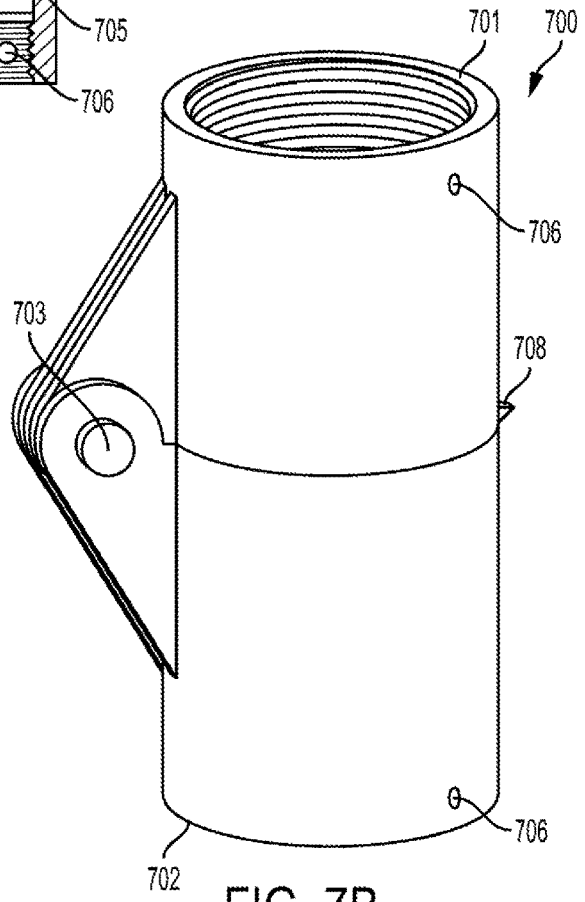
FIG. 7B is a perspective view of the heating device in FIG. 7A, in a closed position.
Figure 7C:
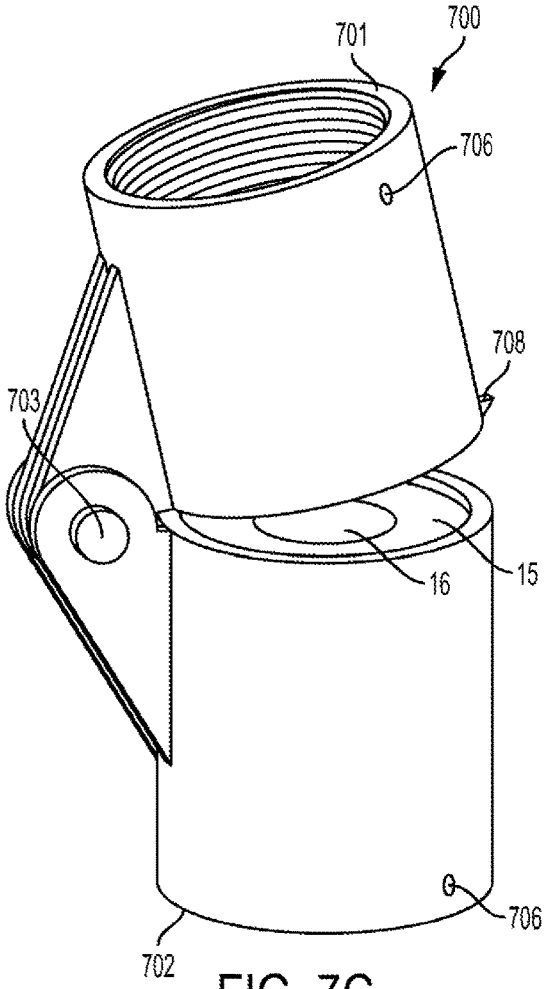
FIG. 7C is a perspective view of the heating device in FIG. 7A, in an open position.
Figure 7D:
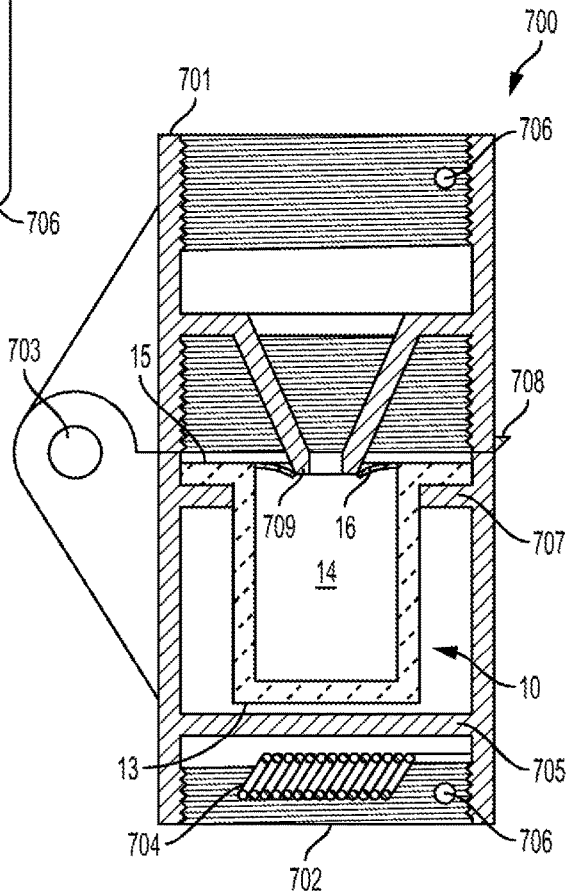
FIG. 7D is a cutaway view of the heating device in FIG. 7A with the container inserted therein.
Figure 7E:
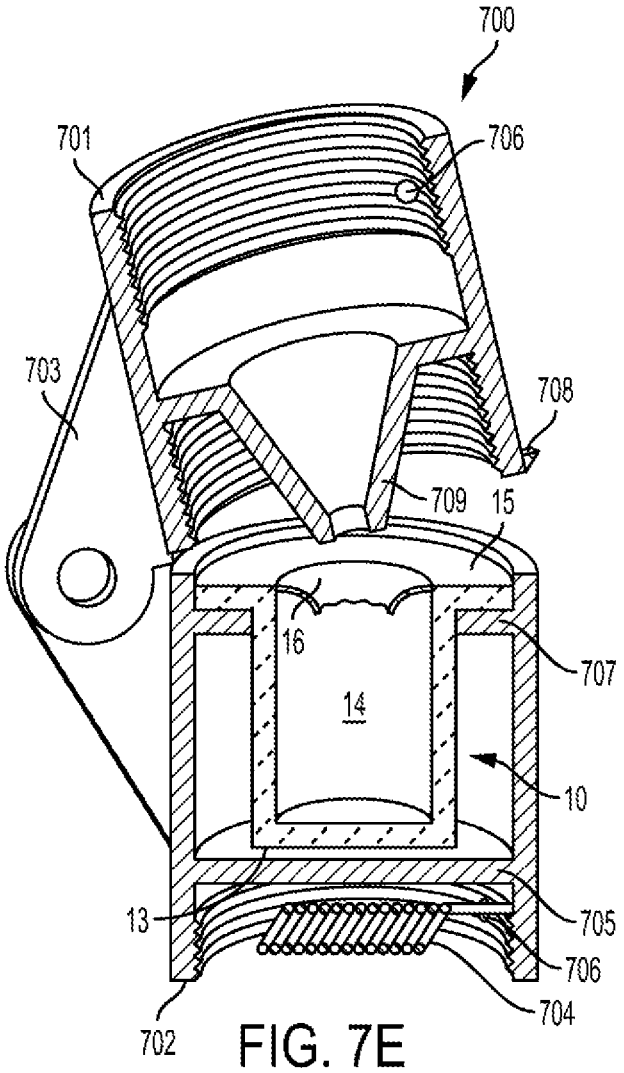
FIG. 7E is a cutaway perspective view of the heating device in FIG. 7A with the container inserted therein.

In some embodiments, the upper part of the lower chamber 702 is threaded, either internally or externally, to accommodate the container 10 when used in conjunction with a connector 300, 400, or 500 of the type disclosed herein. In other embodiments, the upper part of the lower chamber 702 receives the container 10 by a friction or interference fit, with the lip 15 resting on an internal rim 707 inside the chamber 702, as shown in FIG. 7D. A clasp or clip 708 releasably retains and closes the cradle 701 to the chamber 702.

The heating chamber 702, which is disposed beneath the upper cradle 701 when the hinge 703 is shut, includes a heating element 704. The heating chamber 702 may be internally or externally threaded at least toward the bottom thereof so that the chamber 702 can be attached to a control unit (e.g. battery and chipset) such as that shown in FIGS. 2A-2B and 6A-6B. In some embodiments, the heating chamber 702 includes a shelf 705 that provides a resting or stopping point for the bottom of the container 10. The shelf 705 can also function as a heat barrier to provide a secondary barrier against direct heat application to the container 10. In other embodiments, the shelf 705 is omitted such that the container 10 can come closer to or physically touch the heating element 704.

In use, the heating device 700 is attached to a control unit and then the container 10 is loaded into the chamber 702. A connector 300, 400, or 500, may be employed to secure the container inside the chamber 702. However as shown in FIG. 7D, the container 10 is inserted into the chamber 702 such that the lip 15 thereof rests on the internal rim 707. As such, the container 10 extends downward and into the heating chamber 702 such that the bottom 13 of the container 10 rests on or adjacent to heating element 704. A mouthpiece is threaded onto or otherwise inserted or attached to the top of the upper cradle 701.

To obviate the need to manually remove the seal 16 of the container 10, in some embodiments when the upper cradle 701 is closed over the top of the lower chamber 702, the punch 709 breaks and/or punctures the frangible seal 16 of the container 10. The punch 709 remains at or about the container 10 and, in some embodiments, provides an air channel for the aerosol to travel through once such aerosol is generating inside the chamber 702. Accordingly, the cradle 701 functions as a means to puncture and activate the container 10, as an airway, and as a means to connect a mouthpiece of any desired type to the heating device 700. In other embodiments, the punch 709 may be omitted and the user will simply manually remove or break the seal 16 of the container 10. When the user wants to replace the container 10, the cradle 701 is hinged or moved away from the chamber 702 providing access for the user to manually grasp the container 10 to remove it (or simply turn the device over to dislodge the container 10).

It is appreciated and understood that the container 10 provides a substantial health benefit over traditional electronic smoking devices in that the container 10 prevents direct contact between the inhalant material and the heating element of the target electronic smoking device, thereby preventing a potentially toxic reaction between the inhalation material and the heating element. Here, the heating element will only come into physical contact, if it all, with the inert container (glass, quartz, or the like), which container 10. Thus, the inhalant material is heated indirectly heated by the heating element. The avoidance of direct contact between the inhalant material and the heating element also has the further advantage of improving flavor and vapor (or smoke or aerosol) concentration as it provides a cleaner reaction. Empirical testing has shown that use of the container 10 reduces the presence of heavy metal and other toxins in the vapor by a significant percentage, in some cases demonstrating a reduction of up to 95% of such toxins. It is also noted the container 10 provides a substantial convenience advantage over the prior art in that the user no longer has to insert manually inhalant material into the cramped quarters of a traditional heating chamber; rather, the user can simply insert and remove on-demand the ready-to-use and easily handled container 10. The use of the self-puncturing heating device 700 in conjunction with the container 10 even further enhances the usability and convenience of the system.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise. Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means. The enumerated listing of items does not imply that any or all of the items are mutually exclusive, unless expressly specified otherwise. The terms "a", "an" and "the" mean "one or more", unless expressly specified otherwise. Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. In an electronic smoking device, a removable inhalant material container system comprising:

a container comprising a cup-shaped housing having an open top and a closed bottom, the container delimiting an internal storage area wherein the inhalant material is disposed;

a threaded connector having a first end and a second end;

wherein the container is seated in the threaded connector with at least a portion of the container exposed below the connector;

wherein the connector is removably attached to a heating chamber of the electronic smoking device such that the container is inserted inside the heating chamber.

2. The inhalant material container system of claim 1 wherein, in the connector, the first end is externally threaded and the second end is externally threaded.

3. The inhalant material container system of claim 1 wherein, in the connector, the first end is internally threaded and the second end is externally threaded.

4. The inhalant material container system of claim 1 wherein, in the connector, the first end is internally threaded and the second end is internally threaded.

5. The inhalant material container of claim 1, wherein an upper perimeter edge of the housing comprises a lip configured to engage an internal rim of the threaded connector.

6. The inhalant material container system of claim 1, including a washer disposed adjacent to the lip of the container to further retain and secure the container in the connector.

7. The inhalant material container of claim 1, comprising a frangible seal covering the open top of the container.

* * * * *